US005657864A

United States Patent [19]

Harrelson

[11] Patent Number: 5,657,864

[45] Date of Patent: Aug. 19, 1997

[54] BASKET-STYLE CARRIER WITH OPEN ARTICLE-VIEWING AREAS

[75] Inventor: Glen Harrelson, Gainsville, Ga.

[73] Assignee: Riverwood International Corporation, Atlanta, Ga.

[21] Appl. No.: 570,460

[22] Filed: Dec. 11, 1995

[51] Int. Cl.[6] ..... B65D 75/00

[52] U.S. Cl. ..... 206/152; 206/147; 206/175; 206/427; 220/515

[58] Field of Search ..... 206/139, 144, 206/145, 147–149, 152, 160, 167, 169–171, 174, 175, 194, 197, 198, 200, 427, 203; 220/505, 519, 651, 652

[56] References Cited

U.S. PATENT DOCUMENTS

| | | | |
|---|---|---|---|
| 2,702,144 | 2/1955 | Forrer | 206/171 |
| 3,204,815 | 9/1965 | Weiss | 206/171 |
| 3,334,767 | 8/1967 | Cornelius et al. | 220/515 |
| 3,355,012 | 11/1967 | Weiss | 206/200 |
| 4,545,485 | 10/1985 | Oliff | 206/194 |
| 5,458,234 | 10/1995 | Harris | 206/175 |
| 5,485,915 | 1/1996 | Harris | 206/194 |
| 5,524,756 | 6/1996 | Sutherland | 206/140 |

*Primary Examiner*—Paul T. Sewell
*Assistant Examiner*—Luan K. Bui

[57] ABSTRACT

A basket-style carrier containing openings in the side and end panels through which the lower portions of packaged articles can be seen. Flaps connected to one or more opening edges are folded into the interior of the carrier so as to block the pricing bar code on adjacent articles without obstructing the view through the openings. The openings extend down to the bottom panel but do not interfere with connections to riser panels connecting a handle panel to the end panels. The openings also allow the carriers to fit into molded packing trays of the type which include inwardly extending reinforcing elements. The carrier is designed to allow the reinforcing elements to extend into the carrier through the carrier openings.

20 Claims, 7 Drawing Sheets

FIG. 16
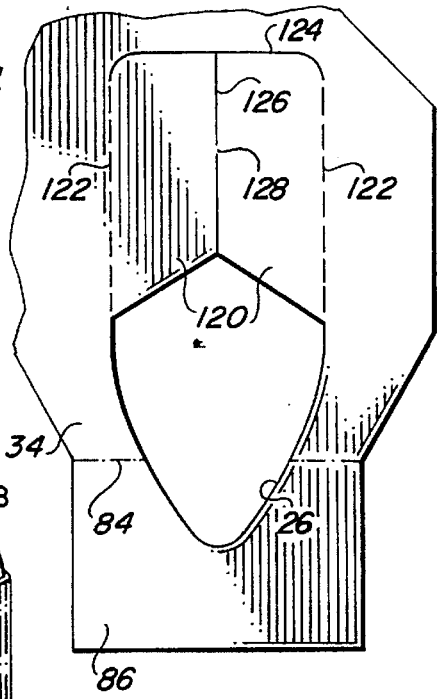
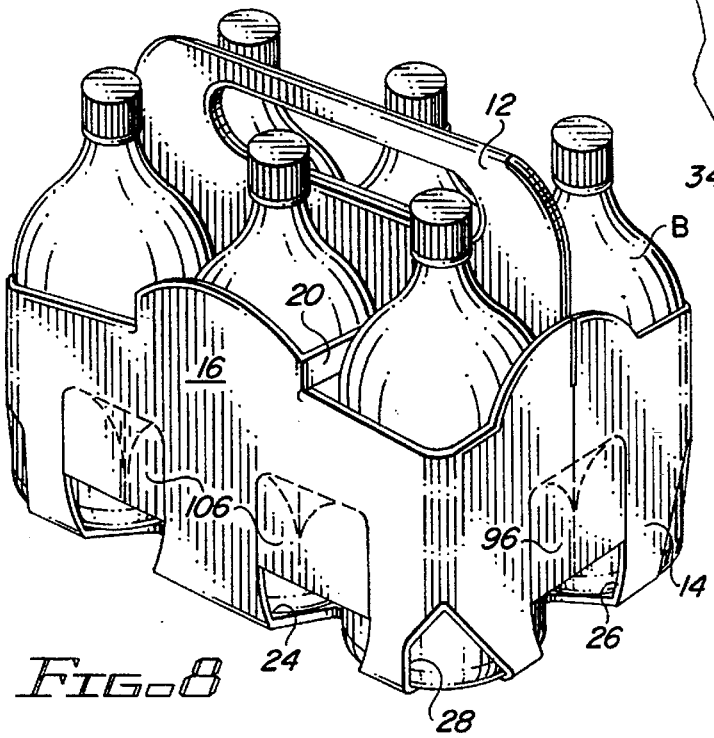
FIG. 8
FIG. 11
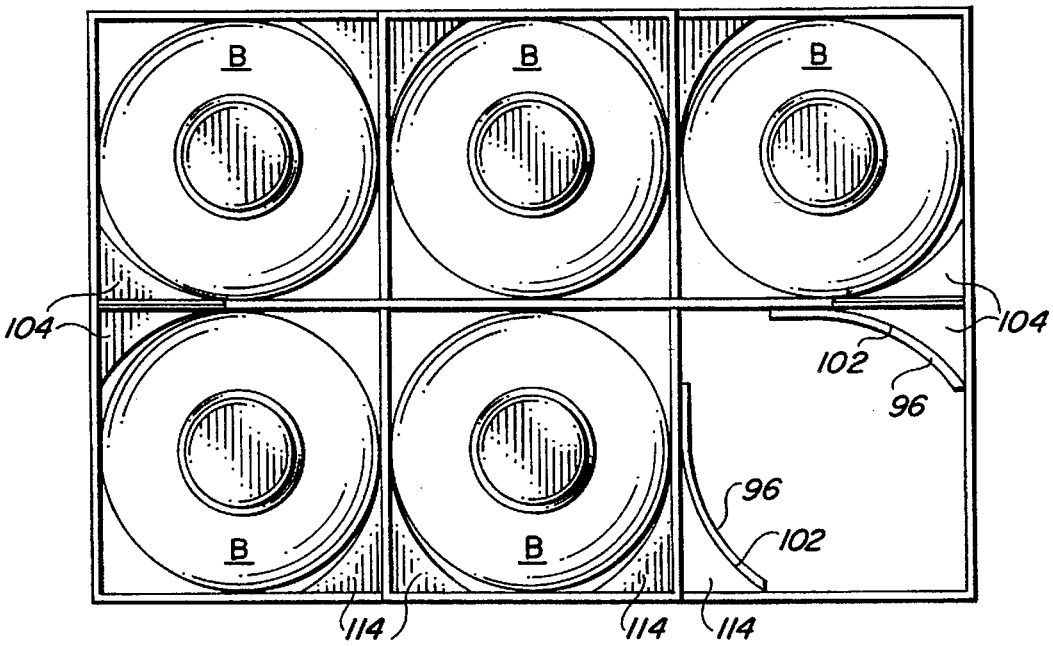

BASKET-STYLE CARRIER WITH OPEN ARTICLE-VIEWING AREAS

FIELD OF THE INVENTION

This invention relates to a basket-style carrier for carrying articles such as beverage bottles. More particularly, it relates to a basket-style carrier which is designed to fit into specialized packer trays and which further allows substantial portions of the packaged articles to be exposed to view.

BACKGROUND OF THE INVENTION

Basket-style carriers are commonly employed to package beverage bottles. They include a separate cell for each bottle, from which the bottles can be readily removed, and a center handle partition for carrying the package. The carriers are fabricated from a blank which is folded and glued into collapsed carrier form, after which the collapsed carrier is erected and the bottles inserted. The loaded basket carriers are then shipped to retail sites in open-top packing trays. Packing trays conventionally have been of rectangular shape designed to hold four basket carriers, with the smooth inner faces of the packing tray walls being dimensioned to allow the carriers to tightly fit after being dropped into place.

More recently designed packing trays are formed of molded plastic. To reduce the weight and cost of the trays their walls consist of spaced segments which are reinforced by vertical struts or posts. This effectively reduces the interior packing space if the outer dimensions of the trays remain the same as the dimensions of trays of the older design. To maintain the interior packing space the same as in prior designs the outer dimensions would have to be increased. Thus the overall size of the trays would be larger, which would defeat the purpose of the cost reduction design. Alternatively, the carriers could be designed to fit into the new trays. It is an object of the invention to provide a basket-style carrier such that four carriers can be loaded into a packing tray of the new design.

Basket-style carriers not only are strong and easy to carry, but their design permits the top portions of bottles packaged in the carrier to be seen. This is advantageous when the distinctive shape of the top portions of the bottles or other packaged articles is suggestive of the brand. The unique shape of some articles, however, is not limited to their top portions but may include their overall appearance, including the design or configuration of the bottom portion. In such cases it is desirable to use a package which exposes as much of the article as possible. It would be expected, however, that such a package might create a problem of carrier strength, since to expose the articles more fully could require structural portions of carriers of conventional design to be eliminated. It would also be expected to create cost problems if the design of the blank from which the carrier is fabricated requires expensive fabrication techniques or if the carrier were to require a two-piece blank.

In addition to these potential problem areas, another area of practical concern is created when exposure of the lower portion of a bottle also exposes portions of the labels on the bottles. When a bottle carrier is checked out at a retail outlet the carrier is held so that the bar code can be read by the price scanner. If the bottle labels are exposed the scanner may read the bar code on an individual bottle label instead, thus charging the wrong price for the carrier.

In addition to the object stated above, another object of the invention is to provide an article carrier which allows major portions of packaged articles to be exposed to view, while providing adequate strength and guarding against erroneous price bar code readings.

BRIEF SUMMARY OF THE INVENTION

The invention is incorporated in a basket-style article carrier for carrying two rows of articles comprised of opposite side panels connected to a bottom panel, opposite end panels connected to the side panels and a handle panel located between the side panels. Each end panel contains an opening spaced from the side panels and each side panel contains an opening spaced from the end panels. Each side panel opening has at least one edge connected by a fold line to a flap which is folded into the interior of the carrier so as to allow the lower portions of adjacent articles to be seen. Flaps may also be provided for the end panel openings. The flaps block the pricing bar code on adjacent articles to prevent erroneous price scanning readings.

In one arrangement the openings have an upper edge which is foldably connected to a flap designed to provide two flap sections, with two angled fold lines forming a triangular section that fits between two adjacent articles. In another arrangement the openings have opposite side edges which are foldably connected to two flaps. Corner areas of the carrier may also include openings through which adjacent articles can be seen.

Preferably, the handle panel is connected to riser panels which are connected to the end panels. The riser panels terminate at their lower end at a point short of the end panel opening so as not to block the opening.

In another aspect of the invention the carriers are adapted to be shipped in a packing tray which includes reinforcing members extending from the side walls to the bottom wall. The carriers are positioned in the tray so that the openings in the side panel adjacent a side wall of the packing tray is substantially aligned with reinforcing members extending from the wall. At least portions of the aligned reinforcing members extend into the openings in the adjacent side panel of a carrier. The reinforcing members help to stabilize the carriers in the tray and, by penetrating into the side panel openings, permit the carriers to fit into trays which other wise would be too small to hold the carriers. Reinforcing members on the end walls of the tray may also extend into the openings in the end panels of the carriers. Preferably, each opening extends into the bottom panel of the carrier to allow the reinforcing members to extend inwardly to the extent necessary.

The tray may also include corner posts, in which case the carriers are provided with corner openings for receiving a portion of an adjacent corner post.

The carrier is structurally sound and economical to produce. In addition, it meets the desired objectives of enabling the bottom portions of packaged articles to be seen, preventing accidental scanning of the pricing bar code of individual articles and enabling the carriers to be packed in molded packing trays having inwardly extending reinforcing members.

These and other features and aspects of the invention will be readily ascertained from the detailed description of the preferred embodiments described below.

BRIEF DESCRIPTION OF THE DRAWING

FIG. 8 is a pictorial view of the carrier after it has been loaded with beverage bottles but before the label blocking structure has been activated;

FIG. 11 is a top plan view of the carrier loaded with bottles except in one of the end cells;

FIG. 16 is an enlarged plan view of a modified cutout in an end panel flap;

DETAILED DESCRIPTION OF THE PREFERRED EMBODIMENTS

Figure 1:
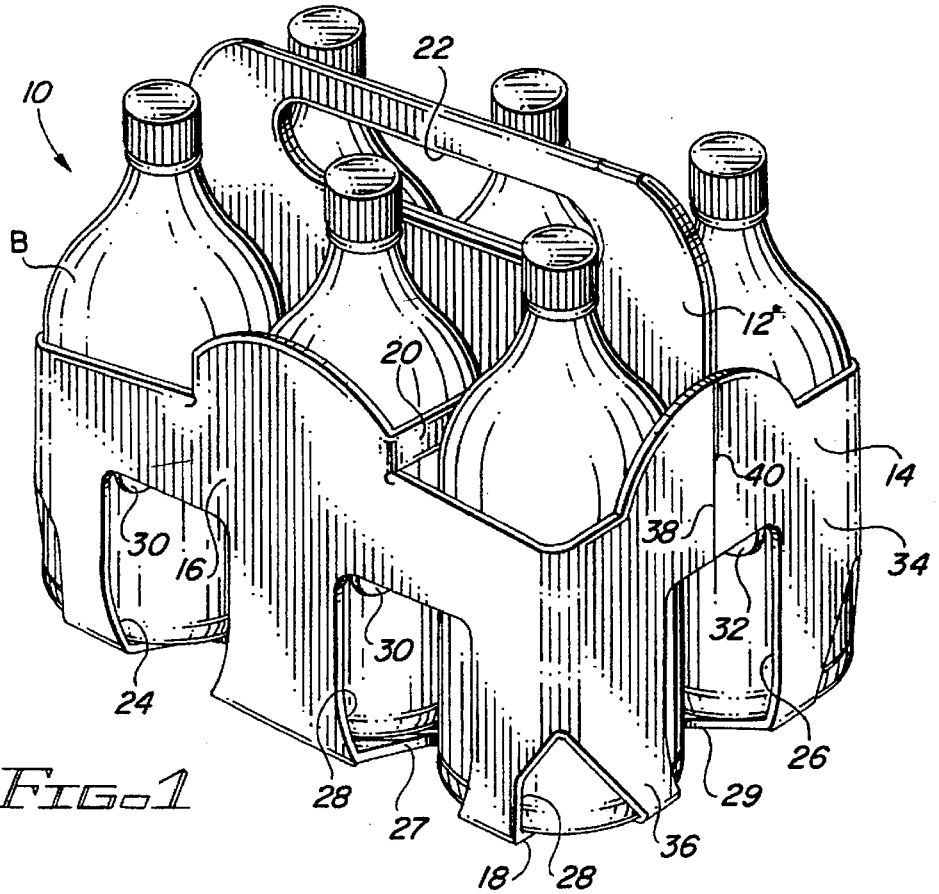
FIG. 1 is a pictorial view of the carrier of the invention, shown holding six beverage bottles.

Referring to FIG. 1, the basket-style carrier 10 of the invention includes a central handle panel 12 connected to end panels 14 through riser panels, which are not visible in this view. The end panels are connected to side panels 16, and the side panels are connected to bottom panel 18. Individual cells for receiving the bottles B are formed by straps 20 which extend from the side panels 16 to the handle panel 12. A handle opening 22 is included in the handle panel. The carrier further includes two large open areas 24 in each side panel and a similar large open area 26 in each end panel. A smaller open area 28 is provided at each corner of the carrier. As illustrated, the bottom panel is also recessed at these open areas as indicated at 27 and 29 for a purpose explained later. The side and end panel open areas act as windows to the interior of the carrier, exposing sufficient amounts of the lower portions of each bottle so that, together with the exposed upper bottle portions, a customer can readily appreciate the overall shape of the bottles regardless of the angle of view. This is a significant commercial feature when the shape of the bottle is associated with the source of the product and is thus part of the process of brand recognition. Small portions of price code blocking flaps or doors 30 and 32 can be seen at the upper portion of the open areas 24 and 26, the details of which are explained below. Each end panel 14 is formed from end panel flaps 34 and 36. The upper portions of the end panel flaps are connected by adjacent fold lines 38 and 40 to the adjacent riser panel while the lower portions of the end panel flaps 34 and 36 just above the end open area 26 overlap and are adhered to each other. This arrangement allows the carrier to remain open during loading as explained more fully below.

Figure 2:
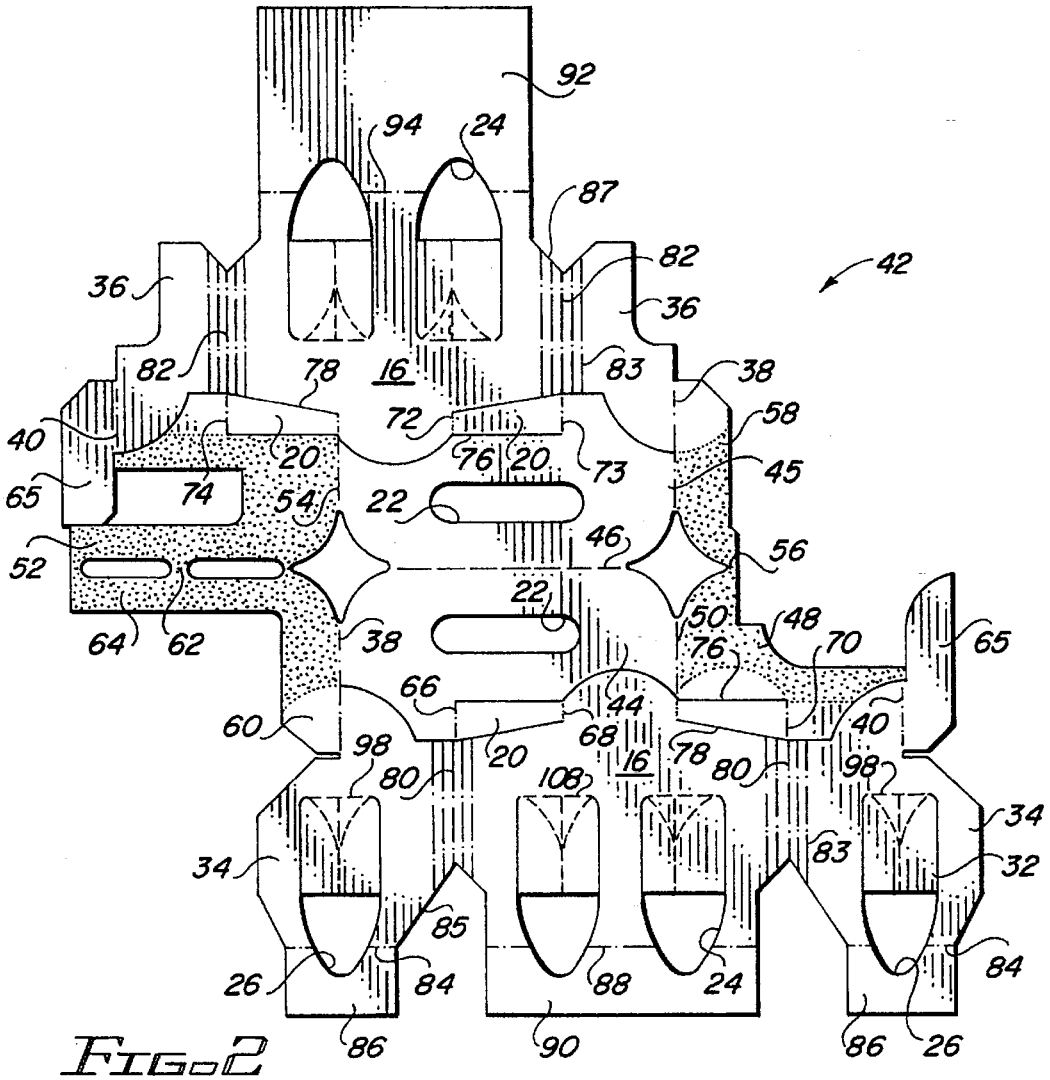
FIG. 2 is a plan view of a blank for forming the carrier of FIG. 1.

Referring to FIG. 2, wherein like reference numerals to those used in FIG. 1 denote like elements, a blank 42 for forming the carrier is shown. Preferably, the blank is formed from paperboard of the type conventionally used in the carrier industry and includes two similar outer handle panel sections 44 and 45 connected to each other by fold line 46. A first inner handle panel section 48 is connected to the outer handle panel section 44 by fold line 50, and a second inner handle panel section 52 is connected to the outer handle panel section 45 by fold line 54. Connected to the inner handle panel section 48 by the short fold line 56 is riser panel flap 58, which is also connected to the outer handle panel section 45 and the adjacent end panel flap 36 by fold line 38. Similarly, riser panel flap 60 is connected to inner handle panel section 52 by fold line 62. Preferably, small cutouts are provided along the fold line 62 for ease of folding. A horizontal extension 64 of the riser panel 60 flap is also connected to the inner handle panel section 52 by the fold line 62 to provide handle reinforcement as explained below. The riser panel flap 60 is connected by fold line 38 to the outer panel section 44 and the end panel flap 34, and two other riser panel flaps 65 are connected to the other end panel flaps 34 and 36 by the fold lines 40.

Two of the cell dividing straps 20 are associated with the outer handle panel section 44 and the other two are associated with the outer handle panel section 45. One of the cell dividing straps 20 is connected at one end by fold line 66 to the outer handle panel section 44 and at the other end by fold line 68 to the side panel section 16. The other cell dividing strap 20 associated with the outer handle panel section 44 is connected at one end to the side panel section 16 by an extension of fold line 50 and at the other end to the inner handle panel section 48 by fold line 70. A similar arrangement exists with the cell dividing straps associated with the outer handle panel section 45, with one strap 20 being connected at one end to the outer handle panel section 45 by fold line 73 and at the other end to the side panel section 16 by fold line 72, the other strap being connected at one end to the inner handle panel section 52 by fold line 74 and at the other end by an extension of fold line 54 to the side panel section 16.

A slit 76 forming the upper edges of the straps 20 separates two of the straps from the inner and outer handle panel sections 48 and 44, and also separates the outer handle panel section 44 from the adjacent side panel section 16. Although the portion of the slit separating the outer handle panel section 44 from the side panel section 16 is arcuate and not aligned with the end portions of the slit, it will be understood that the slit could extend along a continuous straight path, if desired. Slits 78 forming the lower edges of the cell dividing straps 20 extend from the fold lines 68 and 50 along a straight path to separate the straps from the side panel section 16. One of the slits 78 terminates at the fold line 38 of riser panel flap 60, while the other slit 78 terminates slightly past the fold line 40 of riser panel flap 65. Both slits include arcuate portions which separate the end panel flaps 34 from the outer handle panel section 44 and the inner handle panel section 48. Similar slits 76 and 78 are similarly arranged in connection with the other cell dividing straps 20.

Fold lines 80, which connect the end panel flaps 34 to the adjacent side panel section 16, are aligned with the divider strap fold lines 66 and 70. In like manner fold lines 82, which connect the end panel flaps 36 to the adjacent side panel section 16, are aligned with the other divider strap fold lines 73 and 74. Also, it can be seen that fold lines 38 and 50 are aligned with each other, fold lines 38 and 54 are aligned with each other, and fold lines 46, 56 and 62 are aligned with each other. A series of spaced parallel score lines 83 are provided on either side of the fold lines 80 and 82 to enable the corner areas of a carrier formed from the blank to follow the contour of adjacent curved surfaces of packaged articles. In addition, the edges of end panel flaps 34 and the edges of their associated side panel section 16 are spaced apart to form cutaway areas 85, while the edges of end panel flaps 36 and the edges of their associated side panel section 16 are spaced apart to form cutaway areas 87.

Figure 3:
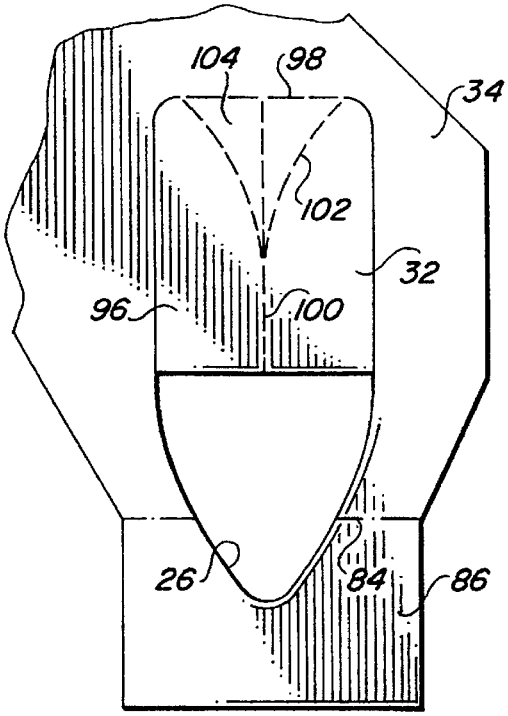
FIG. 3 is an enlarged plan view of a cutout in an end panel flap.
Figure 4:
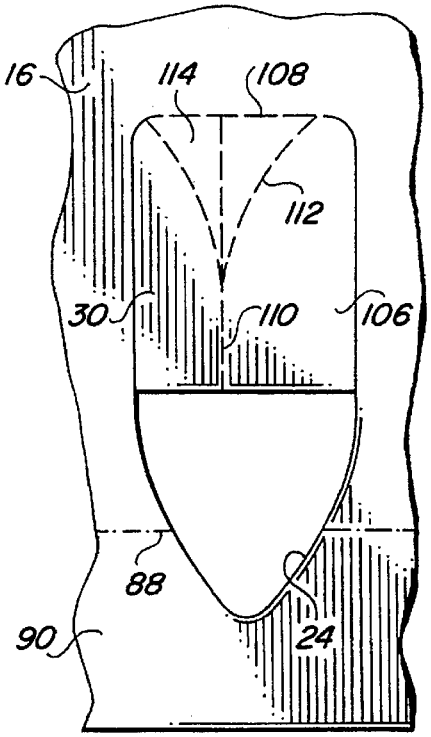
FIG. 4 is an enlarged plan view of a cutout in a side panel section.

Each end panel flap 34 is connected by fold line 84 to bottom panel forming flap 86, and the adjacent side panel section is connected by fold line 88 to bottom panel forming flap 90. A primary bottom panel flap 92 is connected by fold line 94 to the other side panel section 16. The fold lines 88 and 94 are interrupted by the cutouts 24 which extend for a substantial distance into the associated side panel section 16. The cutouts 26 similarly interrupt the fold lines 84 and extend into the associated end panel flaps 34. As best shown in FIG. 3, a flap 96 is connected to the upper edge of each of the cutouts 26 by fold line 98 and is divided by central fold line 100 into smaller flap sections 32. Arcuate fold lines 102 extend from a point on the fold line 100 to the ends of the fold line 98 to form a substantially triangular section 104. As best illustrated in FIG. 4, a somewhat similar arrangement is provided in each of the cutouts 24 of the side panel sections wherein a flap 106 is connected to the upper edge of the cutout by fold line 108. Smaller flap sections 30 of unequal width are created by off-center fold line 110. Arcuate fold lines 112 extend from a point on the fold line 110, one fold line 112 terminating at the end of the fold line 108 and the other fold line 112 terminating at the opposite corner of the cutout. These fold lines form a substantially triangular section 114.

Figure 5:
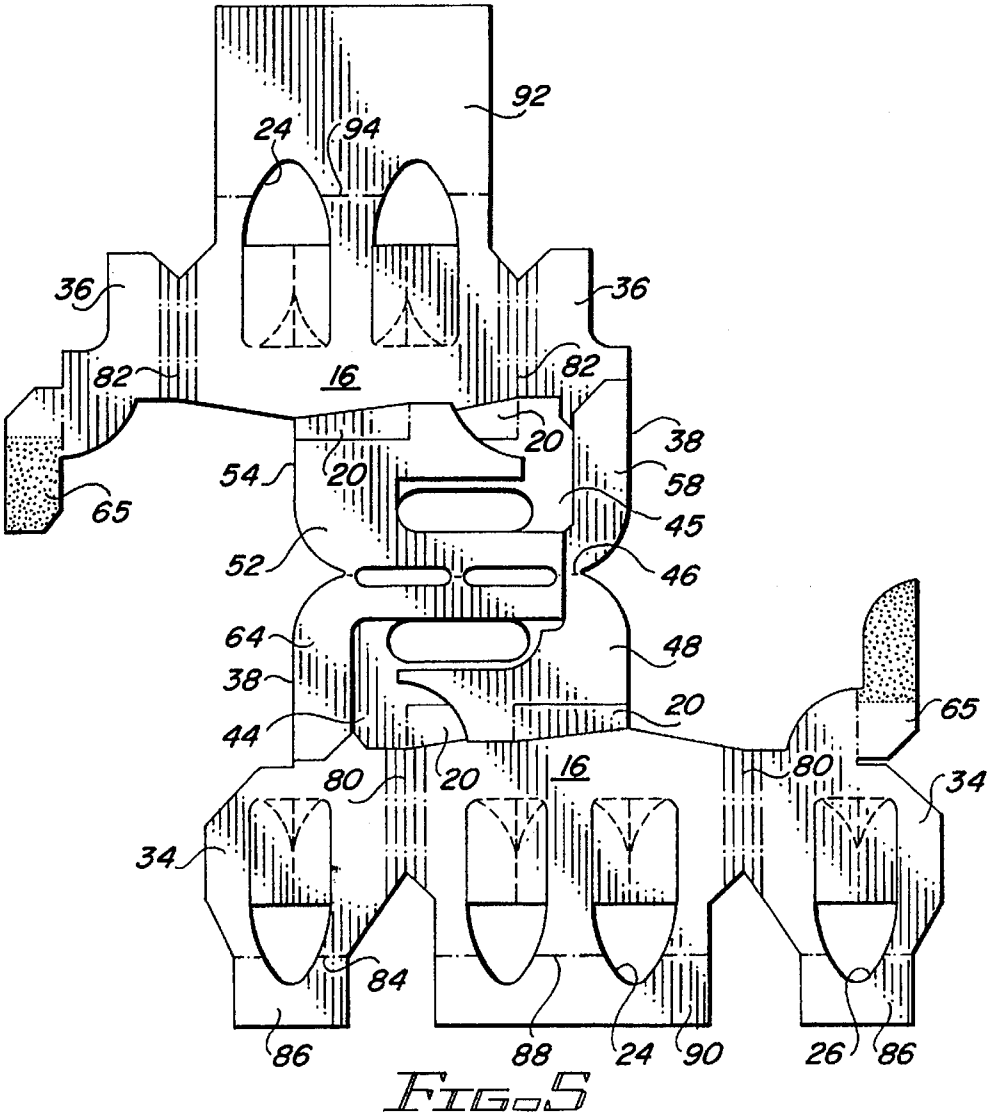
FIG. 5 is a plan view of the blank after an initial folding and gluing step.

To form a carrier from the blank the inner handle panel sections 48 and 52 and portions of the riser panel flaps 58 and 60 are coated with adhesive, as shown in stipple in FIG. 2. Both the inner handle panel sections 48 and 52 and the riser panel flaps 58 and 60 are then pivoted about their fold lines 38, 50 and 54 onto the outer handle panel sections to the position illustrated in FIG. 5. The next step is to apply adhesive to the areas of the riser panel flaps 65, as shown in stipple in FIG. 5. The end panel sections 34 and 36 in the lower right and upper left portions of FIG. 5 are then folded about the fold lines 80 and 82 so that the connected riser panel flaps 65 are adhered to the inner handle panel sections. This produces the interim form of blank shown in FIG. 6.

Figure 7:
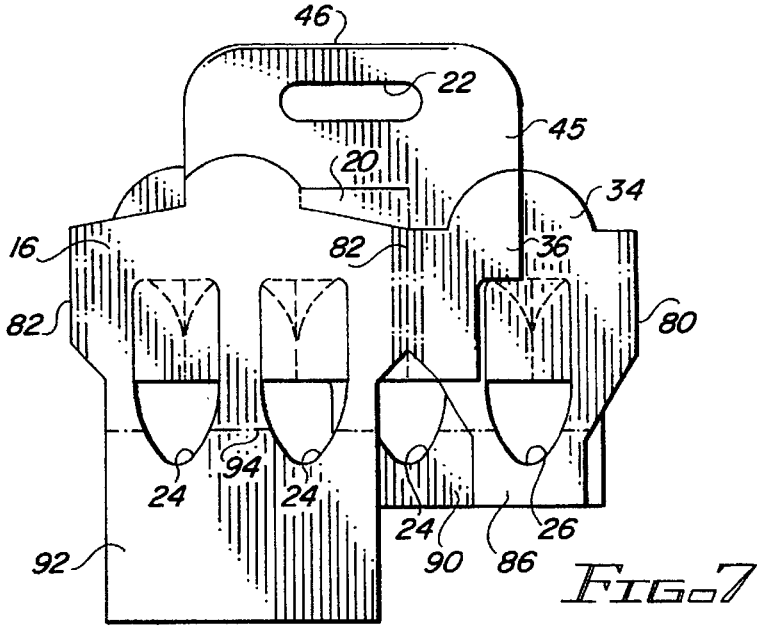
FIG. 7 is a plan view of a collapsed carrier after a final folding and gluing step.
Figure 6:
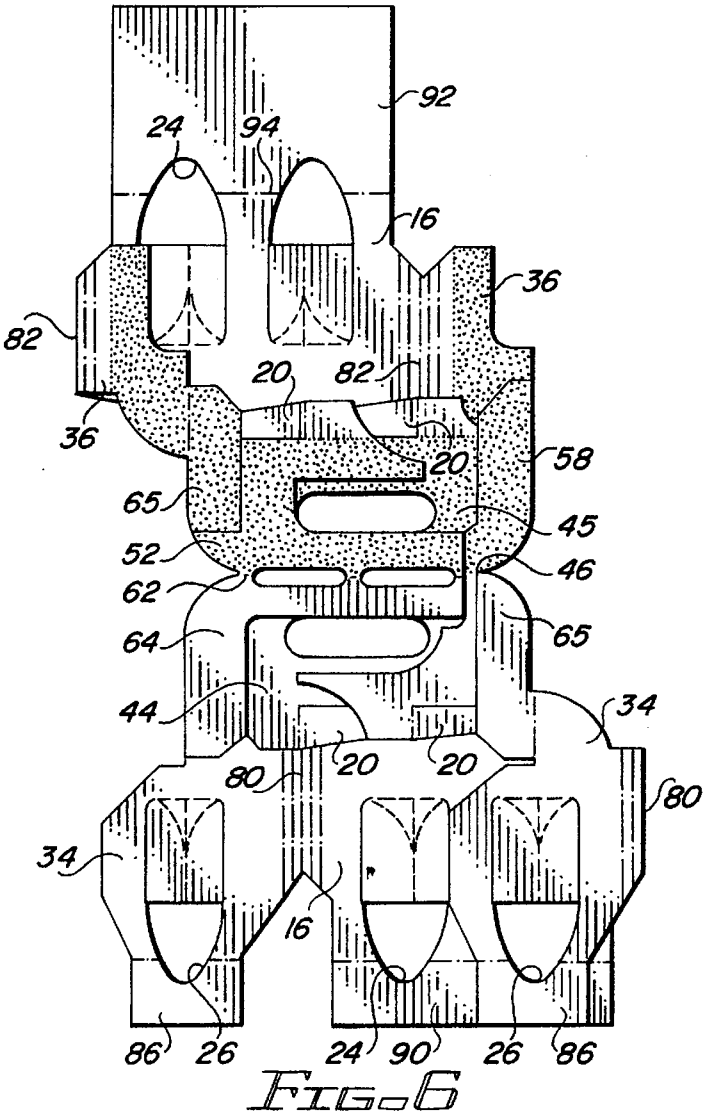
FIG. 6 is a plan view of the blank after a further folding and gluing step.

The final step is to apply adhesive to the stippled areas of FIG. 6 and fold the blank about the fold line 46, adhering the handle panel sections to each other and the riser panel flaps at each end of the handle panel sections to each other to produce the collapsed carrier illustrated in FIG. 7. The end panel formed from the end panel flaps 34 and 36 at the left of the blank of FIG. 2 is coextensive with the lowermost side panel section of the collapsed carrier and the end panel formed from the end panel flaps at the right of the blank of FIG. 2 is coextensive with the lowermost side panel section of the collapsed carrier.

To form a loaded carrier from the collapsed carrier of FIG. 7, the collapsed carrier is squared up by applying inward pressure to the outer ends of the side panel sections. The opened carrier is then aligned with a group of bottles to be packaged and lowered down over them. During this step the bottom panel flap 92 and the bottom panel forming flaps 86 and 90 remain unfolded. After the carrier reaches its final position relative to the bottles, the forming flaps are folded in to bring them up against the bottoms of the bottles. The bottom panel flap is then folded in and adhered to the forming flaps, as by glue, to form the bottom panel of the carrier. The carrier at this stage of formation is illustrated in FIG. 8, in which major portions of the cutouts 24 and 26 are still covered by the flaps 96 and 106.

Figure 9:
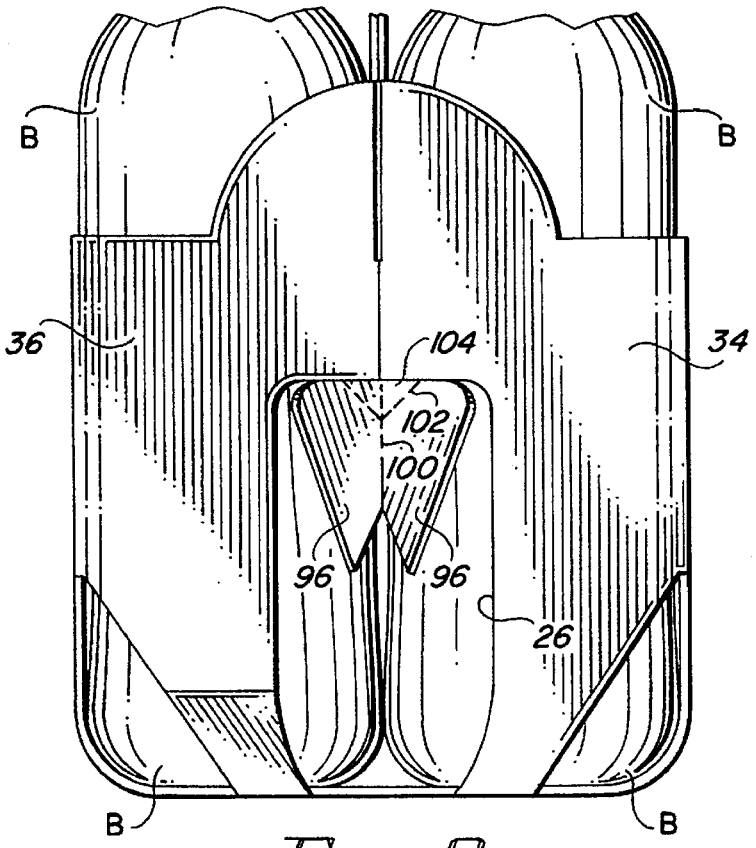
FIG. 9 is a partial end view of the carrier at an interim stage in the folding of the end label blocking structure.
Figure 10:
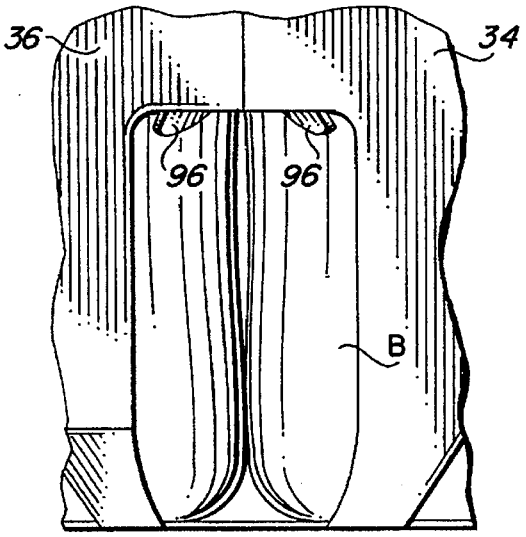
FIG. 10 is a partial end view of the carrier after the label blocking structure has been completely folded into place.

The flaps 96 and 106 are then moved to their final positions by folding the triangular sections of the flaps into the interior of the carrier about their fold lines 98 and 108. Looking at the folding of the flaps 96 as typical of the flaps 106 as well, as the triangular section 104 is pivoted up the flap sections 32 contact the end bottles, causing the flap sections to fold toward each other about the central fold line 100. FIG. 9 illustrates the flap 96 at an interim position during the folding process. Continued folding of the triangular section 104 causes the flap sections 96 to move up until the pivoting movement of the triangular section is stopped by engagement with the handle panel or by the contour of the bottles. As seen in FIG. 10, only the portion of the flap sections 96 adjacent the upper edge of the cutout are visible in their final position. This allows the bottom portions of the end bottles to readily be perceived through the end openings. The same is true of the bottom portions of the bottles adjacent the side panel openings. The view of the lower bottle portions is further enhanced by the portions of the bottles seen through the corner openings 28, which have been formed from the cutaway areas between the lower portions of the side and end panel sections. The position of the triangular section 104 of the end flaps at this point is best illustrated in the top view of FIG. 11, which shows one of the end cells empty for the purpose of better revealing the formed end flap. The stresses caused by the angled connection of the flap sections to the triangular section and the bias of the flap sections 96 against the adjacent bottles maintain the flaps 96 in their final operative position. It can be appreciated that the presence of the triangular sections between the bottles relieves bottle-to-bottle contact and protects against possible breakage.

Figure 12:
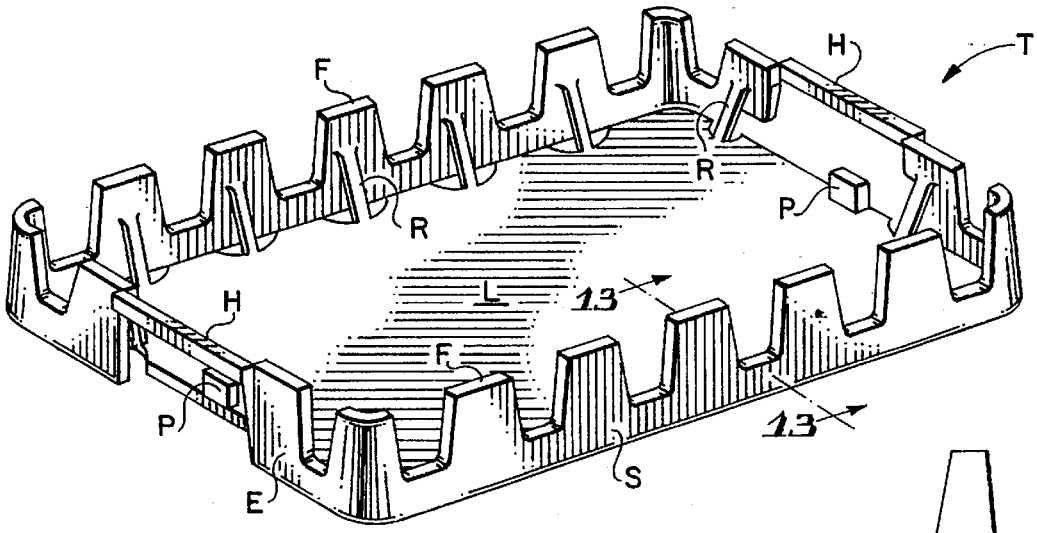
FIG. 12 is a pictorial view of a packing tray of the type in which the carrier of the present invention is designed to be shipped.
Figure 13:
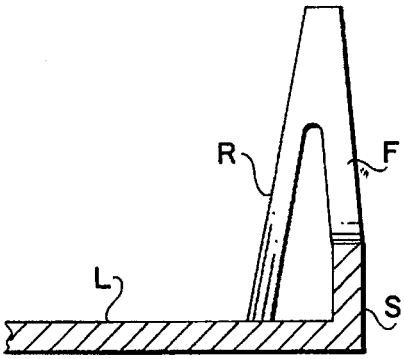
FIG. 13 an enlarged partial sectional view taken on line 13—13 of FIG. 12.

Another aspect of the invention is the relationship of the carrier openings to the packing trays in which they are shipped. A packing tray T formed of molded plastic is illustrated in FIG. 12 as being of generally rectangular shape, with a bottom L integrally connected to continuous side and end walls S and E. Although the bottom of the tray is shown as being solid, it may include openings to reduce the weight of the tray. The walls include regularly spaced gaps which form spaced fingers F, with the fingers at the corners of the tray being in the form of corner posts having curved inner and outer surfaces. Instead of a finger at the midpoint of the end panels a short stub or post P is provided, which creates an open handle area. A handle bar H connects the fingers F on either side of the handle area. As shown in FIG. 13 as well as FIG. 12, the tray is strengthened by reinforcing struts R which slope down from a point on the side and end wall fingers F to the bottom L. There are no struts associated with the corner fingers. The distance between struts on opposite sides of the tray is less than twice the width of basket carriers. Similarly, the distance between struts on opposite ends of the tray is less than twice the length of such basket carriers. It would not be possible, therefore, to pack four conventional basket carriers in the tray since neither the length nor width would be sufficient to receive two abutting carriers. The design of the carrier of the invention, however, permits four carriers to be loaded into the tray.

Figure 14:
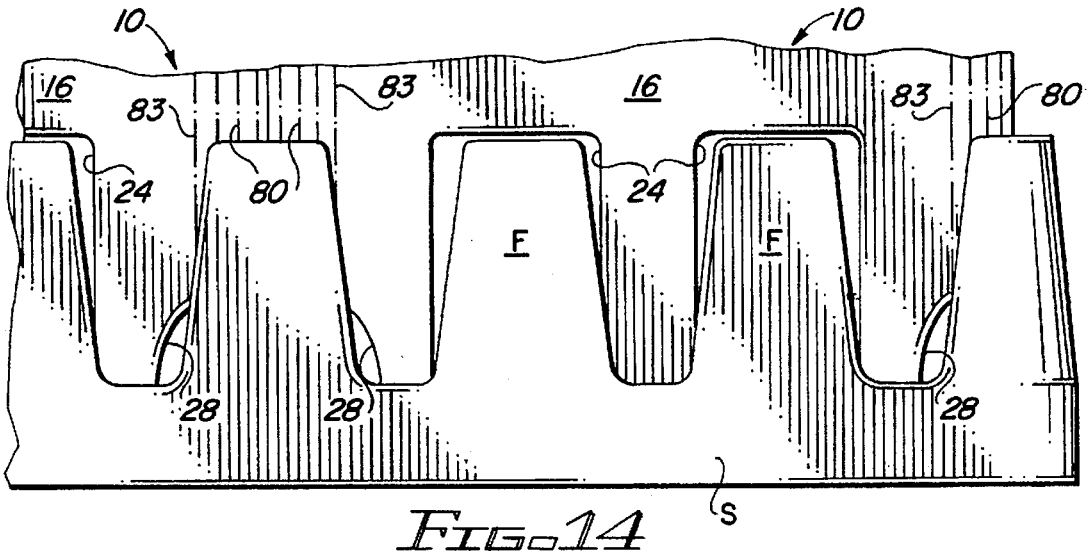
FIG. 14 is an enlarged partial side view of the packing tray containing the carriers of the invention.
Figure 15:
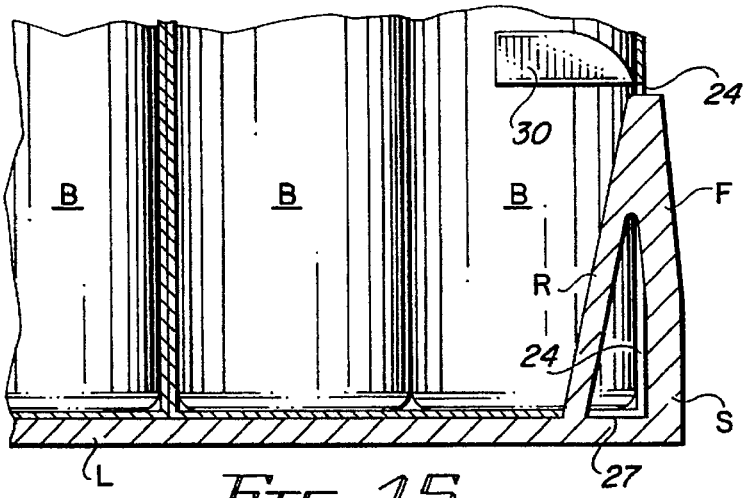
FIG. 15 is an enlarged partial transverse sectional view taken through a side opening of a carrier packaged in the packing tray of FIG. 12.

Referring to FIG. 14, when the carriers of the invention are positioned in the tray the side panel openings 24 are aligned with the side panel fingers F. As shown in FIG. 15, the reinforcing struts R extend through the side panel openings 24 and the adjacent bottom panel recesses 27 between the bottles on either side of the openings. The carriers are thus able to fit within the side panel dimensions of the tray and are completely stabilized by the contact between the bottles and the struts. Although not shown, it will be understood that the end panel openings 26 are also aligned with the end panel fingers F, with the associated struts also extending into the interior of the carrier. The curved corner areas of the carriers created by the score lines 83 enable the carrier corners to follow the curved inner faces of the corner fingers. Due to the spacing of the side panel fingers the line of contact between the adjacent bottles at a side panel opening 24 is slightly to one side of the centerline of the opening. Hence the fold line 110 of the side panel opening flaps 30 is off center to accommodate this relationship. Nevertheless, the side panel opening flaps 30 fold in the same manner as the end panel opening flaps 32, riding up between adjacent bottles.

Not only does the folding of the flap sections of both the end panel cutouts and the side panel cutouts permit entry of the tray struts R into the interior of the carrier and enable the bottom portions of the bottles to be seen, but the folded flap sections also block the pricing bar code on the labels, thus achieving another goal of the invention. It can be appreciated that the design of the carrier enabling the end cutouts to be unobstructed by riser panels results from the use of short riser panels which terminate well above the upper edges of the end cutouts. Despite the use of relatively short riser panels, the carrier is structurally sound and entirely capable of supporting quite heavy loads, such as those encountered in the packaging of beverage containers.

A different type of cutout flap design in illustrated in FIG. 16, which shows an end panel cutout 26 partially covered by a pair of flaps 120 connected by fold lines 122 to the side edges of the cutout. The upper corners and upper edges of the flaps are defined by the slits 124. The inner edges of the flaps are also separated by a slit 126, which may be interrupted by a weak connection, as illustrated at 128, to allow the flaps to normally lie in the same plane until the connection is broken when the flaps are folded.

Figure 17:
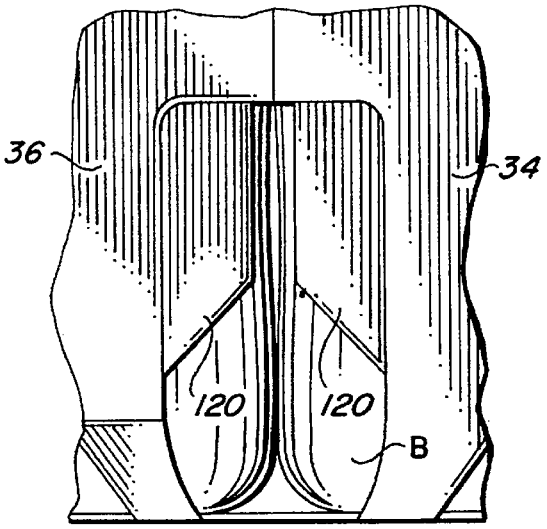
FIG. 17 is a partial end view of a carrier formed with the modified cutout of FIG. 16.

Folding of the flaps 120 requires an inward force to pivot the flaps about the fold lines 122. While the flaps in the first embodiment are folded into place prior to depositing the carriers in the packing tray, the flaps 120 in the FIG. 16 embodiment may be left unfolded at the time the carrier is formed. The flaps may instead be folded in by their contact with the reinforcing struts R at the time the carriers are dropped into place in the tray. The flaps merely fold back against the adjacent bottles, as illustrated in FIG. 17, leaving enough of the cutout open to view the shape of the lower portions of the bottles while at the same time covering portions of the bottles which might contain a pricing bar code. The flaps of the side panel openings may be of unequal widths, as in the first embodiment, if found necessary.

Figure 18:
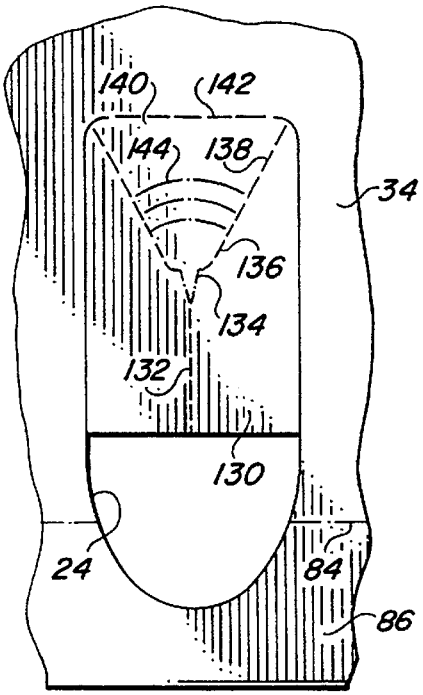
FIG. 18 is an enlarged plan view of another modified cutout in a side panel section.

Another design of a side or end panel flap is shown in FIG. 18. The flap 130 includes a vertical fold line 132 extending from the bottom edge to a V-shaped score line 134. Slits 136 extend from each end of the score line 134 to fold lines 138, which continue up to the corners of the cutouts to define a central triangular panel 140. A fold line 142 at the upper edge of the cutout connects the flap to the side or end panel. The flap is folded in the same manner as the flaps 30 and 32 of the first embodiment. The slits 136 facilitate the folding operation and the V-shaped score lines add strength to the flap at the critical point where the triangular panel 140 converges into the fold line 132. Spaced arcuate score lines 144 in the triangular panel 140 allow the triangular panel to flex if necessary but prevent it from buckling.

Figure 19:
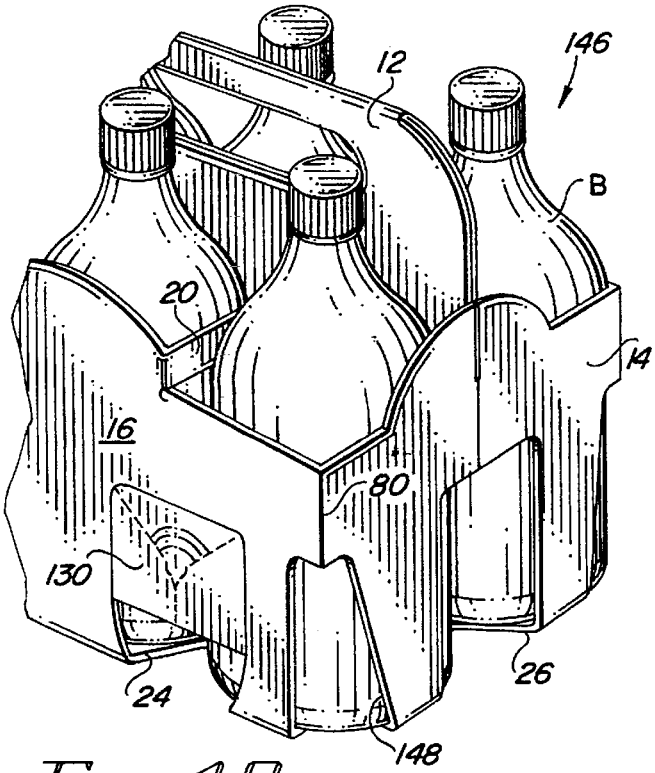
FIG. 19 is a partial pictorial view of a modified carrier incorporating the side cutouts of FIG. 18.

The carrier with which the panel opening flaps 130 are utilized is indicated in FIG. 19 by reference numeral 146. In this embodiment the end openings 26 have not been provided with a flap, and the corner openings 148 are of the same height as, but narrower than, the side and end panel openings. In addition, the corners of the carrier are formed by a substantially right angle fold 80 instead of the curved corner design of the other embodiments. Thus the length of the side panels is slightly greater than the length of the side panels of the other embodiments, resulting in the side panel openings being substantially symmetrically aligned with the packing tray fingers F. The side panel opening flaps are therefore symmetrically divided by the center fold line 132.

Figure 20:
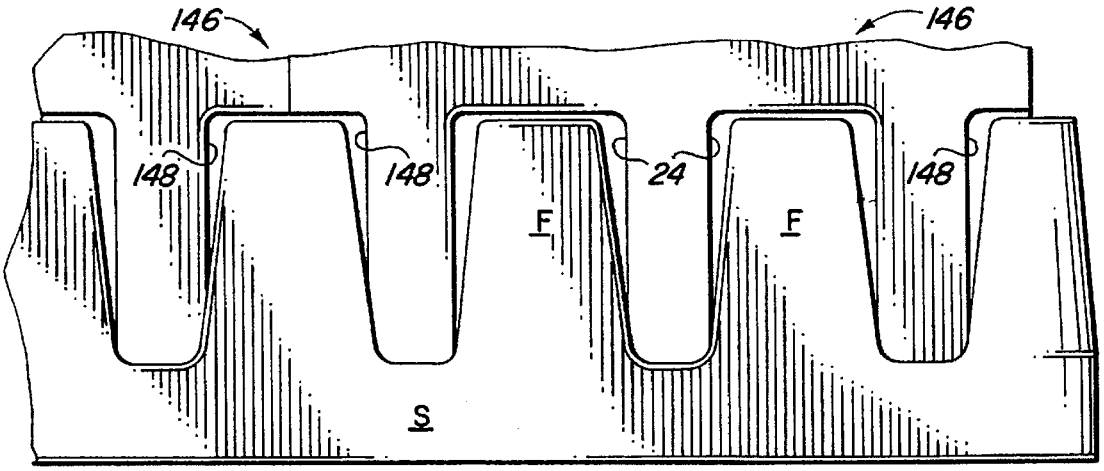
FIG. 20 is an enlarged partial side view similar to that of FIG. 14, but showing the modified carrier of FIG. 19 in the packing tray.

When the carriers of FIG. 19 are positioned in the tray, as illustrated in FIG. 20, the side panel openings 24 are aligned with the side panel fingers F and the side panel flaps are in their folded condition, providing room for the reinforcing struts of the packing tray. The corner openings 148 are positioned to receive the corner tray fingers and, where the end panels of abutting carriers meet, the adjacent corner openings form a combined opening substantially similar in appearance to the side openings.

It should now be appreciated that the cutouts of the embodiments described not only allow the lower portions of bottles packaged in the carrier to be seen while preventing the pricing bar code on a bottle label from being scanned at the check-out counter of a retail outlet, but they also enable the carriers to be packed in molded plastic trays of the type disclosed. Further, the carrier is economical to produce and is structurally adequate.

Although the invention has been described in connection with a carrier designed to hold six beverage bottles, it will be understood that it also applies to carriers designed to hold other types of articles, or to carry fewer or greater numbers of articles. It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A basket-style article carrier for carrying two rows of articles, comprising:

opposite side panels connected to a bottom panel;

opposite end panels connected to the side panels;

a handle panel located between the side panels;

the handle panel including opposite ends connected by fold lines to riser panels, the riser panels being connected by fold line to an associated end panel;

each end panel being comprised of two end panel sections, each end panel section being foldably connected to one of the opposite side panels;

one of the end panel sections of each end panel having a relatively wide portion extending transversely beyond the fold line connecting the end panel to the riser panels, the relatively wide portion overlapping and being adhered to the associated end panel section;

each end panel containing an opening substantially equally spaced from the side panels; and each side panel containing an opening spaced from the end panels;

each side panel opening having at least one edge connected by a fold line to a flap, said flap being folded into the interior of the carrier so as to allow bottom portions of adjacent articles to be seen through the side panel opening.

2. A basket-style article carrier for carrying two rows of articles, comprising:

opposite side panels connected to a bottom panel;

opposite end panels connected to the side panels;

a handle panel located between the side panels;

each end panel containing an opening substantially equally spaced from the side panels and extending for a substantial distance into the bottom panel;

each side panel containing an opening spaced from the end panels and extending for a substantial distance into the bottom panel;

each side panel opening including an upper edge;

a flap connected by a fold line to the upper edge of each side panel opening, each side panel flap including a substantially vertical interior fold line and two angled fold lines originating on said interior fold line and extending toward the fold line at the upper edge of an associated opening, each side panel flap being folded into the interior of the carrier so as to allow bottom portions of adjacent articles to be seen through the side panel openings, the angled fold lines and the fold line at the upper edge of said associated opening forming an inwardly extending triangular section.

3. A basket-style article carrier as defined in claim 2, wherein a flap is connected by a fold line to the upper edge of each end panel opening, each end panel flap including a substantially vertical interior fold line and two angled fold lines originating on said interior fold line and extending toward the fold line at the upper edge of an associated opening, each end panel flap being folded into the interior of the carrier so as to allow bottom portions of adjacent articles to be seen through the end panel openings, the angled fold lines and the fold line at the upper edge of said associated opening forming an inwardly extending triangular section.

4. A basket-style article carrier as defined in claim 2, wherein the carrier includes a corner area where each end panel is connected to a side panel, each corner area including an opening spaced from the openings in the side and end panels and extending into the bottom panel.

5. A blank for forming a basket-style carrier, comprising:

two outer handle panel sections connected to each other by a central fold line;

each outer handle panel section having opposite end edges extending substantially at right angles to the central fold line and a lower edge extending transversely of the end edges;

an inner handle panel section connected by a fold line to one of the end edges of each of the outer handle panel sections;

a riser panel flap connected by fold line to the opposite end edge of each of the outer handle panel sections;

two pairs of spaced end panel sections on each side of the central fold line, each end panel section connected by fold line to a riser panel flap;

one pair of end panel sections containing an opening spaced from an associated side panel section;

a side panel section connected to and located between each pair of spaced end panel sections; and each side panel section containing an opening spaced from an associated end panel section, each side panel opening having at least one edge connected by a fold line to a flap, said flap being foldable into the interior of a carrier formed from the blank so as to allow bottom portions of articles packaged in such a carrier to be seen.

6. A blank as defined in claim 5, wherein each end panel opening has at least one edge connected by a fold line to a flap, the flap being foldable into the interior of a carrier formed from the blank so as to allow bottom portions of articles packaged in such a carrier to be seen.

7. A blank as defined in claim 5, wherein each side panel opening includes an edge which is the upper edge of a side panel opening in a carrier formed from the blank, the flap of each side panel opening being connected by fold line to said upper edge, each flap including an interior fold line dividing the flap into two flap sections and two angled fold lines originating on said interior fold line and extending toward the fold line at the upper edge of an associated opening, the angled fold lines and the fold line at the upper edge of said opening forming a triangular section.

8. A blank as defined in claim 7, wherein each flap section is of substantially similar width.

9. A blank as defined in claim 7, wherein one of the flap sections of each flap is of greater width than the other flap section of said flap.

10. A blank as defined in claim 5, wherein each side panel opening includes opposite edges designed to be the side edges of a side panel opening in a carrier formed from the blank, each side panel opening being associated with two flaps, each said flap being connected by fold line to a side edge of said opening.

11. A blank as defined in claim 5, wherein each side panel section and each end panel section has a bottom edge, the openings in the side panel sections and the end panel sections extending through the bottom edges thereof.

12. A shipping package, comprising:

a packing tray having a bottom wall, opposite side walls and opposite end walls;

a plurality of reinforcing members extending from the side walls to the bottom wall;

a plurality of basket-style article carriers in the packing tray, each carrier including opposite side panels, opposite end panels, a bottom panel and a handle panel, the carriers being arranged in the tray so that the side walls of the packing tray are adjacent a side panel of a carrier;

each side panel of the carriers having at least one opening therein;

the carriers being positioned so that the opening in the side panel adjacent a side wall of the packing tray is substantially aligned with a reinforcing member of extending from said side wall;

at least a portion of the aligned reinforcing member extending into the associated opening in the adjacent side panel of a carrier.

13. A shipping package as defined in claim 12, wherein each carrier includes a flap foldably connected to an edge of each side panel opening in the carrier, the flap being folded into the interior of the carton.

14. A shipping package as defined in claim 13, wherein each opening includes an upper edge, the flap of each opening being connected by fold line to the upper edge of said opening, each flap including an interior fold line dividing the flap into two flap sections and two angled fold lines originating on said interior fold line and extending toward the fold line at the upper edge of the opening, the angled fold lines and the fold line at the upper edge of said opening forming a triangular section.

15. A shipping package as defined in claim 14, wherein the triangular section of each flap extends inwardly of the carrier transversely of the side panel to which said flap is connected, the articles in the carriers being bottles and the triangular section of each flap extending partially between adjacent bottles.

16. A shipping package as defined in claim 13, wherein each opening includes opposite side edges, each opening being associated with two flaps, each flap being connected by fold line to a side edge of said opening.

17. A shipping package as defined in claim 12, wherein a plurality of reinforcing members extend from the end walls of the tray to the bottom wall, the end panels of the carriers having at least one opening therein, the carriers being positioned so that the end wall opening is substantially aligned with an end wall reinforcing member of the packing tray, at least a portion of the end wall reinforcing member extending into the opening in the adjacent end wall of a carrier.

18. A shipping package as defined in claim 12, wherein the packing tray includes corner posts, each carrier having corner portions including an opening therein, the corner posts of the packing tray being adjacent a corner opening of an adjacent carrier and extending partially through said corner opening.

19. A shipping package as defined in claim 17, wherein each carrier includes a flap foldably connected to an edge of each end panel opening in the carrier, the flap being folded into the interior of the carton.

20. A shipping package as defined in claim 19, wherein each end panel opening includes an upper edge, the flap of each end panel opening being connected by fold line to the upper edge of said opening, each flap including an interior fold line dividing the flap into two flap sections and two angled fold lines originating on said interior fold line and extending toward the fold line at the upper edge of the opening, the angled fold lines and the fold line at the upper edge of said opening forming a triangular section.

* * * * *